US005758365A

United States Patent [19]

Steeley

[11] Patent Number: 5,758,365

[45] Date of Patent: Jun. 2, 1998

[54] SPORT GLOVE AND SUPPORT INSERT

[76] Inventor: David D. Steeley, 15484 Eastwood Rd., Mt. Orab, Ohio 45154

[21] Appl. No.: 834,254

[22] Filed: Apr. 15, 1997

[51] Int. Cl.[6] ..... A41D 19/00

[52] U.S. Cl. ..... 2/161.1; 473/61; 2/160

[58] Field of Search ..... 2/160, 161.1, 161.2, 2/163, 162, 166, 907; 473/59, 61, 62, 205, 212

[56] References Cited

U.S. PATENT DOCUMENTS

| | | | |
|---|---|---|---|
| 4,441,711 | 4/1984 | Dubar et al. | 473/61 |
| 4,608,720 | 9/1986 | Purin | 2/161.1 |
| 5,453,064 | 9/1995 | Williams, Jr. | 2/161.1 |
| 5,456,650 | 10/1995 | Williams, Jr. et al. | 2/161.2 |
| 5,511,247 | 4/1996 | Block | 2/161.1 |

*Primary Examiner*—Michael A. Neas

*Attorney, Agent, or Firm*—Niro, Scavone, Haller & Niro

[57] ABSTRACT

A sports glove has a single-piece support insert adapted to be received therein along the top of one or more fingers, the hand and the wrist in order to provide support, protection and performance enhancement to the user. The glove is flexible so it can provide firm yet resilient support in order to maintain the support insert in place during movement. The support insert can be molded or deformed for customized fit.

17 Claims, 3 Drawing Sheets

SPORT GLOVE AND SUPPORT INSERT

BACKGROUND OF THE INVENTION

The present invention relates generally to hand and wrist support devices for sports and, more specifically, to a support device and glove for bowling.

In sports such as bowling it is necessary to repeatedly execute specific physical motions in a consistent manner to accurately cause the object, such as a bowling ball, to act in a certain way. A particular physical motion may demand a certain amount of strength, stamina and coordination, especially if executed repeatedly. For instance, to achieve a desired roll or spin in bowling while delivering the ball at the right speed, the bowler's body parts, especially the hand and wrist, must be held in a very specific position throughout execution. Such demand can cause fatigue or even injury. It is therefore desirable to provide a device that will aid an athlete in properly maintaining form throughout execution and in preventing fatigue and injury.

Various known devices have been proposed for the problem described. Some devices include a multi-piece support apparatus that is adapted to rigidly hold the hand, wrist and one or more fingers in place. Such known devices require multiple adjustments or are bulky and cumbersome. Because they are bulky and cumbersome they require multiple straps or other means to secure them to the user's hand and they do not allow the user to wear a glove. Furthermore, such devices tend to be costly to manufacture.

It is desirable, therefore, to provide a practical, versatile device that provides a user with the support and protection of prior known support devices, that enhances the user's performance, that is cost- and space-efficient, and that enables the user to wear a glove with it.

SUMMARY OF THE INVENTION

The present invention relates to a support device and, alternatively, a support device with a corresponding sport glove, for overcoming the aforementioned shortcomings of the prior art and for providing support, protection and performance enhancement to the user. The present invention comprises a generally flat, rigid support member made of unitary construction and adapted to contact and support the back of the user's hand, fingers and, optionally, wrist. Portions of the support member corresponding to specific body parts such as a finger may be adjusted to the user's preference. The support member is adapted to be removably received securely in a flexible glove that is designed to provide the user with support and enhanced gripping ability.

DESCRIPTION OF THE PREFERRED EMBODIMENTS

Figure 1:
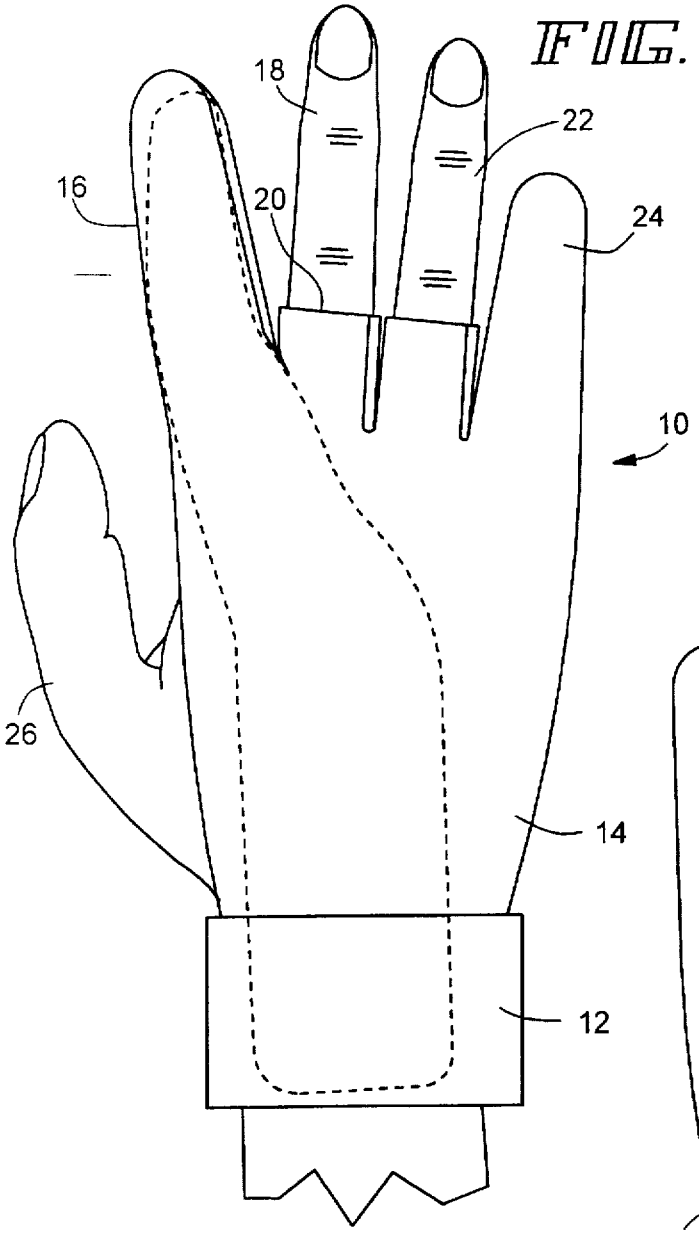
FIG. 1 is a top view of the sport glove and insert of the present invention fitted on the hand of a user.
Figure 2:
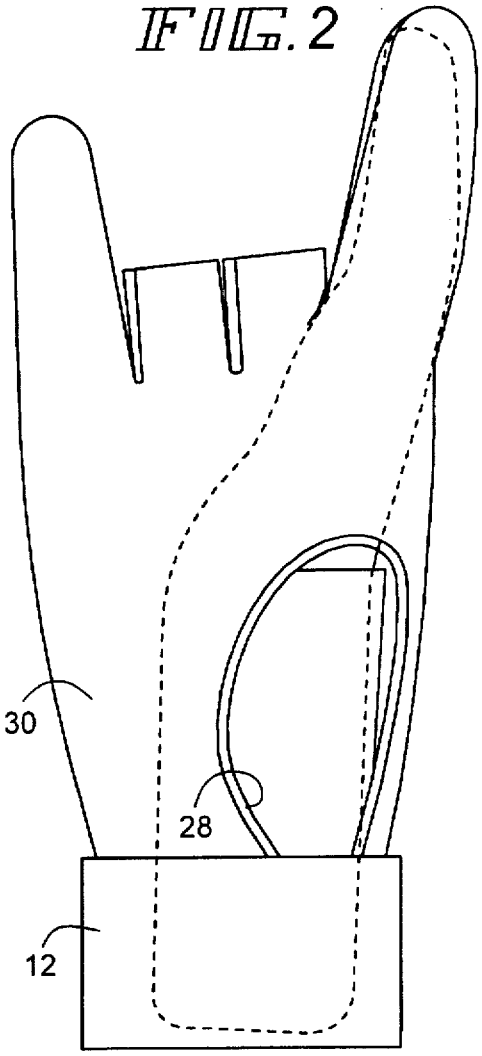
FIG. 2 is a bottom view of the sport glove and insert of FIG. 1.
Figure 5:
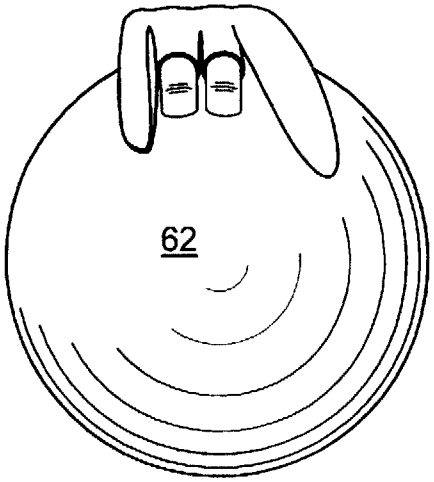
FIG. 5 is a partial front and top view of the sport glove of FIG. 1 fitted on the had of a user gripping a bowling ball.

As shown in FIG. 1, the present invention generally comprises an article, such as a glove 10, that can be worn around the user's hand, or hand and wrist. The glove 10 can be made from any suitable flexible material that will provide a snug fit to provide support for and to stay positioned with respect to the user's hand and wrist. Various suitable materials include any fabric having stretching properties such as spandex or polyester. The glove 10 of FIG. 1 includes a wrist portion 12 that is adapted to fit around and support the user's wrist. The wrist portion 12 may be a closed section that stretches around the user's wrist or it may be an open section that closes around the user's wrist by any known means including VELCRO, snaps, buckles or the like. The glove back section 14 should be made from stretchable fabric to maintain a snug supporting fit during any movement of the hand and wrist. It is preferable to construct the palm side 30, shown in FIG. 2, of the glove 10 from leather or leather-like vinyl to enable positive gripping contact with the object to be held, such as a bowling ball 62, as shown in FIG. 5. The portions of the glove 10 covering the index finger 16 and the little finger 24 are preferably the full length of the user's finger's to protect the fingers and enhance gripping of the ball 62. The portions of the glove 10 that cover the middle finger 18 and the ring finger 22 may each have a cut end, as shown at 20, to enable the user's bare fingers to be inserted into the bowling ball 62. If further preferable, the glove 10 can be configured with a thumb opening 28 to allow the user's thumb 26 to be completely exposed.

Figure 3:
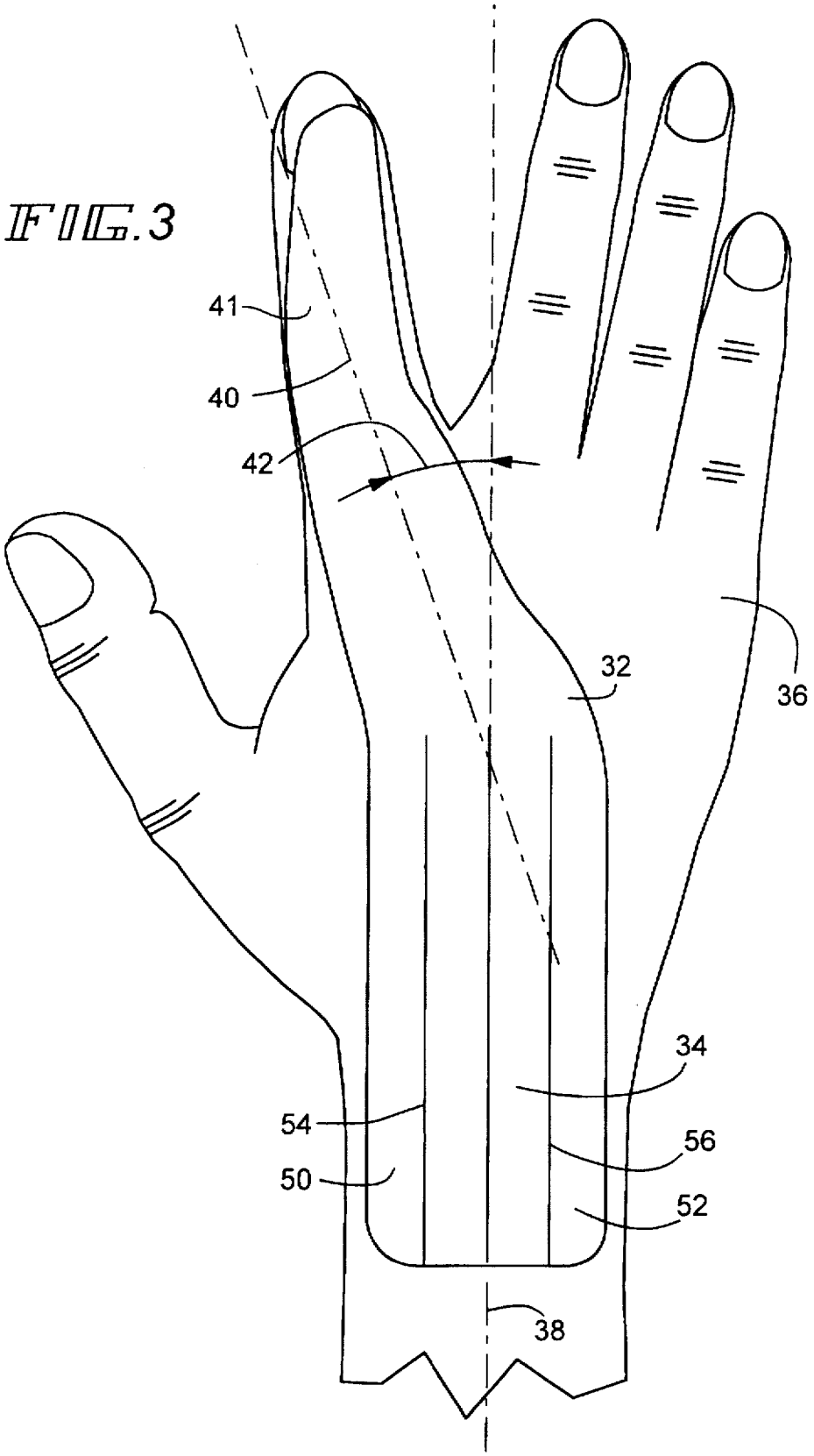
FIG. 3 is a top view of the insert of the present invention positioned on a user's hand.

As shown in FIG. 3, an insert plate 32 is adapted, in the preferred embodiment, to fit against the back side of the user's hand, wrist and index finger. If desirable, it is possible to configure the insert plate to contact any one or more of the user's fingers, or to contact only the hand and fingers but not the wrist. The insert plate 32 shown in FIG. 3 has a lower portion 34, an upper portion 36, a longitudinal axis 38 lying in a first plane, and a secondary axis 40 which lays in the first plane but is oriented at a first acute angle 42 with respect to the longitudinal axis 38. The secondary axis 40 is aligned with and defines the plate finger portion 41 which is adapted to support and maintain the position of the user's index finger.

Figure 4:
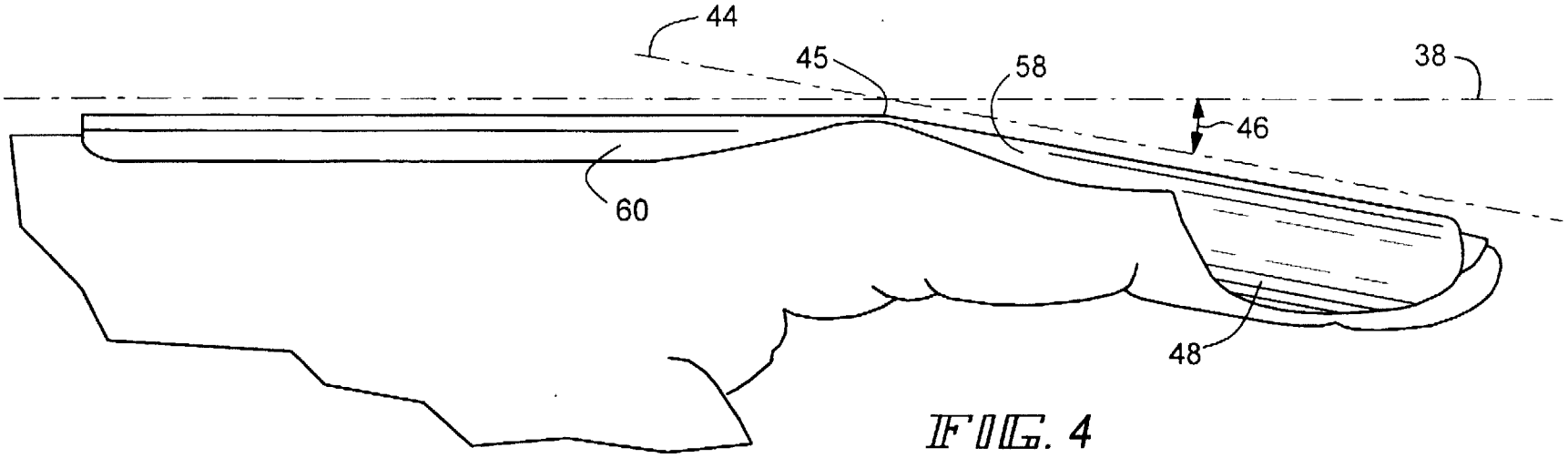
FIG. 4 is a side view of the insert of FIG. 3 positioned on a user's hand.

As shown in FIG. 4, it is preferable to form the plate finger portion 41 so that it lays in a second plane 44 which is at a second acute angle 46 measured with respect to the first axis 38 of the first plane. While any desired angle may be used, the optimum range for angle 46 in the preferred embodiment is from about 5 to 20 degrees. The approximate point at which the first and second planes intersect is at the juncture 45 of the index finger and the hand. A finger side wall 48 is formed on the side of the index finger adjacent to the middle finger. The finger side wall 48 maintains the position of the index finger with respect to the middle finger when the insert plate 32 is held relative to the hand.

It is preferable to construct the insert plate 32 from a strong yet pliable material such sheet metal so that the finger portion 41, and any sub-portion of it, may be adjusted to any preferred.

The lower portion 34 of the insert plate 32 may have contoured sides 50, 52, as shown in FIG. 3, that are contoured to fit partially around the user's wrist in order to comfortably align and stabilize the insert plate 32. The contoured sides 50, 52 diverge from the first plane at imaginary lines 54 and 56 shown in FIG. 3. The insert plate 32 may have further contour sections as shown at 58 and 60 which partially fit around the user's finger or ridge of the hand in order to add further support and stabilization.

While the insert plate 32 can be attached to the user's hand, wrist and fingers by a variety of means including simple bandagelike straps or belts without the use of a glove, in the preferred embodiment the insert 32 is inserted directly inside the glove 10. As shown in FIG. 6, the interior of the glove 10 may include an insert pocket 62 or similar means adapted to securely maintain the insert 32 in a desired position within the glove 10. The insert pocket 62 may be constructed from a patch 64 of any, flexible material or fabric. It is preferable that the patch 64 be made from a soft, thick material such as foam rubber in order to provide padding for the user's comfort. The patch 64 is sewn or fixed in place by other means. It is preferable that the insert pocket 62 be adapted for easy insertion and removal of the insert 32. This enables removal of the insert 32 for washing of the glove or for adjustment or exchange of the insert 32. The insert 32 may be selectively bent to a desired shape or a set of multiple inserts configured for specific lane conditions or types of shots maybe utilized.

A second embodiment of the present invention is disclosed in FIG. 7. The second embodiment includes an insert plate 132, similar to the insert plate 32 of FIG. S 1–6, except that the lower portion 134 does not extend to the user's wriest, but instead terminates above the hand-wrist joint 135, enabling bending movement of the wrist. In the embodiment of FIG. 7, the insert plate 132 is shown with one plate finger portion 141 for the index finger. It is contemplated, however, that the insert plate 132 may have portions that correspond to any one or more of the user's fingers. The insert plate 132 of FIG. 7 is adapted to have all the characteristics of and be used with a glove or other attaching means as discussed above with respect to FIG. S 1–6.

It should be apparent that the present invention will provide the advantages of reduced fatigue and injury, enhanced accuracy and consistency, and enhanced gripping in sports.

While the preferred embodiment of the invention has been described herein, it is contemplated that variations and modifications thereof may be made without departing from the scope of the presently claimed invention.

What is claimed is:

1. A sports glove comprising:

a covering portion made of a flexible material and adapted to fit around the user's hand, a portion of the user's wrist and at least one of the user's fingers, wherein said finger around which said covering portion is fitted is the user's index finger; and a substantially rigid plate adapted to be received within said covering portion and further adapted to be held in contact with the back side of the user's wrist, hand and said finger, said rigid plate having a longitudinal axis aligned with an imaginary line extending from the middle of the user's wrist to the tip of the user's middle finger; a lower plate portion extending in a first plane from the user's wrist to a first point located between the user's wrist and the tip of the user's middle finger, said lower portion being aligned with said longitudinal axis; and an upper plate portion extending from said first point to the end of said index finger, said upper plate portion extends generally along an imaginary line that starts at said first point and extends in said first plane at a first acute angle from said longitudinal axis such that said finger is held in a position spaced apart from said middle finger.

2. A sports glove according to claim 1, wherein said rigid plate consists of a unitary piece of generally flat material.

3. A sports glove according to claim 1, wherein said rigid plate is formed from a flat metal sheet.

4. A sports glove according to claim 1, wherein said rigid plate is made of molded plastic.

5. A sports glove according to claim 1, wherein said upper plate portion is generally aligned in a second plane which extends from said first plane at a second acute angle with respect to said first plane.

6. A sports glove according to claim 5, wherein said upper plate portion is adapted to be adjusted to a variety of desired shapes or angles.

7. A sports glove according to claim 1, wherein said upper plate portion has a sidewall extending along the side of the user's index finger that is adjacent to the user's middle finger, said sidewall extending from the tip of the user's index finger to a distance that is less than the length of said index finger.

8. A sports glove according to claim 7, wherein said covering portion has an internal pocket for removably receiving said rigid plate therein.

9. A sports glove according to claim 1, wherein said covering portion has an adjustable wrist section for selectively securing said glove on said user's hand.

10. A hand support for bowling comprising:

a unitary, substantially rigid plate adapted to be held in contact with the back side of the user's wrist, hand and index finger, said rigid plate comprises a longitudinal axis aligned with an imaginary line extending from the middle of the user's wrist to the tip of the user's middle finger; a lower plate portion extending in a first plane from the user's wrist to a first point located between the user's wrist and the tip of the user's middle finger said lower portion being aligned with said longitudinal axis; and an upper plate portion extending from said first point to the end of said index finger, said upper plate portion extends generally along an imaginary line that starts at said first point and extends in said first plane at a first acute angle from said longitudinal axis such that said finger is held in a position spaced apart from said middle finger; and securing means for selectively securing said rigid plate to said user's wrist, hand and index finger.

11. A hand support according to claim 10, wherein said rigid plate is formed from a flat metal sheet.

12. A hand support according to claim 10, wherein said rigid plate is made of molded plastic.

13. A hand support according to claim 10, wherein said upper plate portion is generally aligned in a second plane which extends from said first plane at a second acute angle with respect to said first plane.

14. A hand support according to claim 13, wherein said upper plate portion is adapted to be adjusted to any desired shape or angle.

15. A sports glove according to claim 10, wherein said upper plate portion has a sidewall extending along the side of the user's index finger that is adjacent to the user's middle finger, said sidewall extending from the tip of the user's index finger to a distance that is less than the length of said index finger.

16. A sports glove comprising:

a covering portion made of a flexible material and adapted to fit around the user's hand and at least one of the user's fingers; and a substantially rigid plate adapted to be received within said covering portion and further adapted to be held in contact with the back side of the user's hand and said finger;

said rigid plate comprising a longitudinal axis aligned with an imaginary line extending from the middle of the user's wrist to the tip of the user's middle finger; a lower plate portion extending in a first plane from the portion of the user's hand adjacent to the wrist to a first point located between said portion and the tip of the user's middle finger, said lower portion being aligned with said longitudinal axis; and an upper plate portion extending from said first point to the end of said index finger, said upper plate portion extends generally along an imaginary line that starts at said first point and extends in said first plane at a first acute angle from said longitudinal axis such that said finger is held in a position spaced apart from said middle finger, and said upper plate portion is generally aligned in a second plane which extends from said first plane at a second acute angle with respect to said first plane.

17. A sports glove according to claim 16, wherein said upper plate portion has a sidewall extending along the side of the user's index finger that is adjacent to the user's middle finger, said sidewall extending from the tip of the user's index finger to a distance that is less than the length of said index finger.

* * * * *